United States Patent [19]

McCallum

[11] 4,129,315

[45] Dec. 12, 1978

[54] PLAY VEHICLE

[76] Inventor: David F. McCallum, #D 10330 114th St., Edmonton, Alberta, Canada

[21] Appl. No.: 787,773

[22] Filed: Apr. 15, 1977

[51] Int. Cl.[2] ..... B62B 11/00

[52] U.S. Cl. ..... 280/87.01; 280/81 R

[58] Field of Search ..... 280/87.01, 87.02 R, 280/87.03, 87.04 R, 87.04 A, 81 R, 11.1 R, 11.1 BT, 32.6, 15, 17, 1.186, 1.201, 1.22, 1.203, 408, 410; 104/53, 58, 59, 63, 69, 70; 272/56.5

[56] References Cited

U.S. PATENT DOCUMENTS

| | | | |
|---|---|---|---|
| 1,098,262 | 5/1914 | Hollingshead | 280/32.6 |
| 1,483,033 | 2/1924 | Wisman | 280/87.04 R |
| 3,399,904 | 9/1968 | Schinke | 280/87.03 X |
| 3,795,409 | 3/1974 | Cudmore | 280/87.04 A |

*Primary Examiner*—John A. Pekar

*Attorney, Agent, or Firm*—Daniel Jay Tick

[57] ABSTRACT

A plurality of wheels are rotatably mounted on the surface of a plate type member in a manner whereby the member is movable on different types of terrain. The member supports a rider on its top surface.

1 Claim, 4 Drawing Figures

PLAY VEHICLE

BACKGROUND OF THE INVENTION

The present invention relates to a play vehicle.

Objects of the invention are to provide a play vehicle of simple structure, which is inexpensive in manufacture and functions efficiently, effectively and reliably to amuse and entertain people of all ages, and especially children, by rolling on any type of terrain.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The play vehicle of the invention comprises a plate type member 1 of any suitable material such as, for example, plastic. The member 1 has a top surface 2 (FIGS. 1 to 3), a bottom surface 3 (FIGS. 2 to 4), a length L (FIG. 2) and a width W (FIG. 3). The member 1 supports a rider (not shown in the FIGS.) on its top surface 2.

A plurality of wheels 4 to 16, and so on, are rotatably mounted on the bottom surface 3 of the member 1 in a manner whereby the vehicle is movable on different types of terrain. In the illustrated embodiment of the invention, 25 wheels are mounted on the bottom surface 3 of the member 1.

Figure 2:
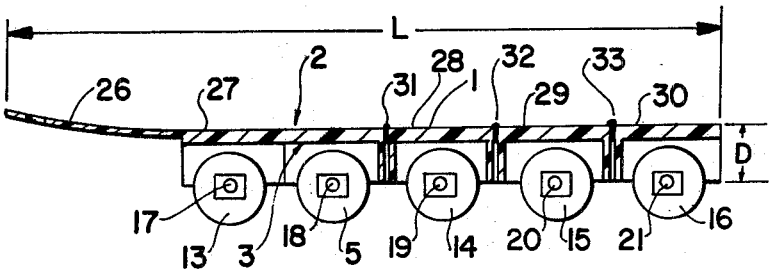
FIG. 2 is a sectional view, taken along the lines II—II, of FIG. 1.
Figure 3:
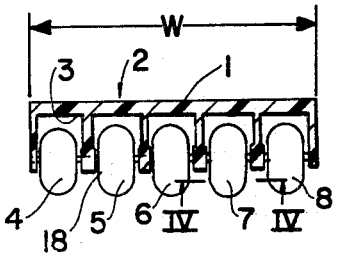
FIG. 3 is a sectional view, taken along the lines III—III, of FIG. 1.
Figure 4:
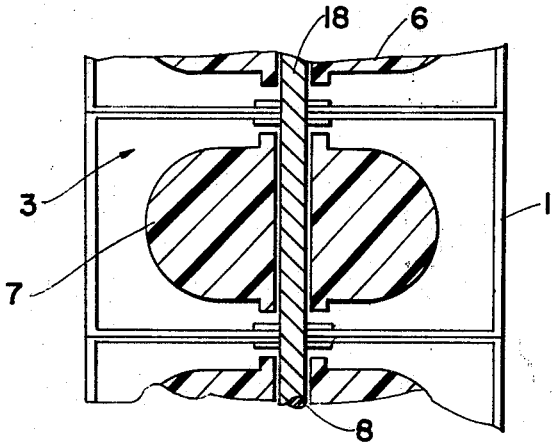
FIG. 4 is a view, on an enlarged scale, partly in section, taken along the lines IV—IV, of FIG. 3.

As shown in FIGS. 2, 3 and 4, a plurality of shafts 17, 18, 19, 20 and 21 are provided. Each of the shafts 17 to 21 is mounted a predetermined distance D (FIG. 2) beneath the bottom surface 3 of the member 1. Each of the shafts 17 to 21 extends widthwise of the member 1 in spaced parallel relation with the other shafts.

The wheels 4 to 16, and so on, are provided in five groups of five wheels each. Each of the wheels of the first group of five wheels is rotatably mounted on the shaft 17. Each of the wheels 4 to 8 of the second group of five wheels is rotatably mounted on the shaft 18, and so on.

The mounting of the wheels is, of course, not limited to the embodiment shown, since each wheel may be rotatably mounted independently from the others, there being no common shafts. Furthermore, of course, any suitable number of wheels may be provided in each group and any suitable number of groups may be provided.

Figure 1:
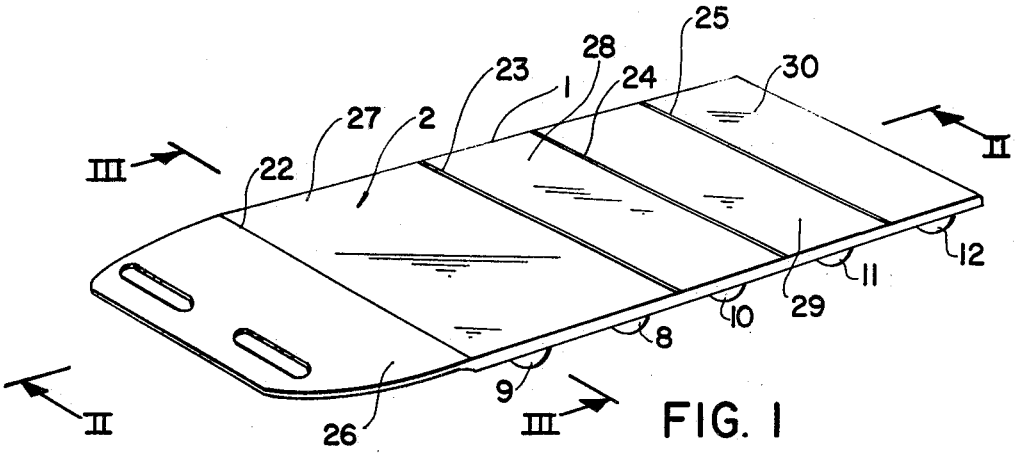
FIG. 1 is a perspective view of an embodiment of the play vehicle of the invention.

In the illustrated embodiment of the play vehicle of the invention, the plate type member 1 is divided by widthwise extending cuts 22, 23, 24, and 25 (FIG. 1) into a plurality of parts 26, 27, 28, 29 and 30 (FIGS. 1 and 2). The shafts 17 and 18 are mounted on the bottom surface of the part 27, the shaft 19 is mounted on the bottom surface of the part 28, the shaft 20 is mounted on the bottom surface of the part 29 and the shaft 21 is mounted on the bottom surface of the part 30.

A plurality of hinges 31, 32 and 33 (FIG. 2) hingedly affix the parts 27 and 28, 28 and 29, and 29 and 30, respectively, to each other in a manner whereby the plate type member 1 is flexible along its length from part to part. The member 1 thus yields, to a certain extent, due to the hinges 31, 32 and 33, as it moves over rough terrain, thereby avoiding structural stresses.

While the invention has been described by means of a specific example and in a specific embodiment, I do not wish to be limited thereto, for obvious modifications will occur to those skilled in the art without departing from the spirit and scope of the invention.

I claim:

1. A play vehicle, comprising a plate member having a top surface, a bottom surface, a length and a width, said member supporting a rider on its top surface, said plate member being divided by widthwise extending cuts into a plurality of parts;

a plurality of shafts each mounted a predetermined distance beneath the bottom surface of the member and each extending widthwise of the member in spaced parallel relation with the other shafts, corresponding ones of the parts having corresponding ones of the shafts mounted thereon;

a plurality of groups of wheels, each group having an equal number of wheels and each group of wheels being rotatably mounted on a corresponding one of the shafts spaced from the bottom surface of the member in a manner whereby the vehicle is movable on different types of terrain; and a plurality of hinge means hingedly affixing the parts to each other in a manner whereby the plate member is flexible along its length from part to part.

* * * * *